US010231540B1

(12) United States Patent
Hong

(10) Patent No.: US 10,231,540 B1
(45) Date of Patent: Mar. 19, 2019

(54) SLIDE DEVICE WITH LOCKING FUNCTION

(71) Applicant: JEONHAN CO., LTD., Chungcheongbuk-do (KR)

(72) Inventor: Jang Sun Hong, Seongnam-si (KR)

(73) Assignee: JEONHAN CO., LTD., Chungcheongbuk-do (KR)

( * ) Notice: Subject to any disclaimer, the term of this patent is extended or adjusted under 35 U.S.C. 154(b) by 0 days.

(21) Appl. No.: 15/847,573

(22) Filed: Dec. 19, 2017

(30) Foreign Application Priority Data

Sep. 26, 2017 (KR) ..... 10-2017-0123897

(51) Int. Cl.
*E05C 3/14* (2006.01)
*E05B 65/46* (2017.01)
*A47B 88/473* (2017.01)

(52) U.S. Cl.
CPC ..... *A47B 88/473* (2017.01); *E05B 65/46* (2013.01); *E05C 3/14* (2013.01)

(58) Field of Classification Search
CPC ..... A47B 88/44; A47B 88/443; A47B 88/447; E05C 3/14
USPC ..... 312/333
See application file for complete search history.

(56) References Cited

U.S. PATENT DOCUMENTS 6,502,910 B2 * 1/2003 Kuo-Chan ..... A47B 88/487 312/333
6,805,418 B2 * 10/2004 Milligan ..... A47B 88/49 312/333
7,604,309 B2 * 10/2009 Chen ..... A47B 88/487 312/333
7,611,213 B2 * 11/2009 Wu ..... A47B 88/493 292/80
8,147,011 B2 * 4/2012 Chen ..... H05K 7/1489 312/333
8,393,692 B2 * 3/2013 Yu ..... H05K 7/1489 312/333
2005/0017613 A1 * 1/2005 Cirocco ..... A47B 88/493 312/333
2006/0033408 A1 * 2/2006 Chiu ..... A47B 88/407 312/333
2008/0018214 A1 * 1/2008 Huang ..... A47B 88/49 312/334.46
2009/0001864 A1 * 1/2009 Huang ..... A47B 88/49 312/333

(Continued)

FOREIGN PATENT DOCUMENTS

KR 20-0377395 Y1 3/2005
KR 10-1730427 B1 4/2017

*Primary Examiner* — Daniel J Rohrhoff
(74) *Attorney, Agent, or Firm* — Novick, Kim & Lee, PLLC; Jae Youn Kim

(57) ABSTRACT

There is provided a slide device with a locking function to smoothly support the movement of a movable body, such as a drawer, to be movably installed in a fixed body, such as a box-type frame, which comprises: a fixed rail fixedly mounted on the fixed body; a first movable rail movably installed in the fixed rail in a forward-backward direction; a second movable rail movably installed in the first movable rail in the forward-backward direction and fixedly mounted on the movable body; a locking unit positioned at an inner front end of the fixed rail, to lock the second movable rail; and a locked member pivotally installed at an outer front end of the second movable rail, to be locked to the locking unit of the fixed rail by a pivot support pin.

4 Claims, 7 Drawing Sheets

(56) References Cited

U.S. PATENT DOCUMENTS

| | | | | |
|---|---|---|---|---|
| 2016/0262538 | A1* | 9/2016 | Chen | H05K 7/1489 |
| 2017/0159710 | A1* | 6/2017 | Chen | F16C 43/04 |

* cited by examiner

SLIDE DEVICE WITH LOCKING FUNCTION

CROSS-REFERENCE TO RELATED APPLICATION

This application claims priority to Korean Patent Application No. 10-2017-0123897 filed on Sep. 26, 2017, the disclosure of which is hereby incorporated herein by reference in its entirety.

BACKGROUND OF THE INVENTION

1. Field of the Invention

The present invention relates to a slide device with a locking function and more particularly, to a slide device with a locking function to prevent a movable body such as a drawer which is mounted on a movable rail from undesirably sliding open from a fixed body such as a box-type frame on which a fixed rail is mounted due to an external vibration, by locking the movable rail to the fixed rail when the movable rail is received into the fixed rail.

2. Description of the Related Art

In the present invention, a slide device is to smoothly secure the movement of a movable body, such as a drawer to be movably mounted on a fixed body such as a box-type frame.

The slide device includes a fixed rail and a movable rail to be movably installed onto the fixed rail.

The fixed rail of the slide device is mounted on the fixed body and the movable rail of the slide device is mounted onto the movable body.

For example, in a chest of drawers, a drawer which is the movable body is mounted on the box-type frame which is the fixed body, to be movable in a forward-backward direction. The fixed rail of the slide device is mounted on the box-type frame and the movable rail of the slide device is mounted on the drawer.

In the slide device which is mounted on a marine cabinet, an aircraft cabinet, a hospital cabinet, a portable cabinet or a maintenance tool box, when an external vibration is applied to a movable body which is in a closed position, the movable body held by the movable rail of the slide device is not retained in the closed position and slides away from the fixed body.

When the movable body slides away from the fixed body by the external vibration, maybe various articles kept in the movable body pour out and are damaged. Further, when the articles fall down, surrounding people may be injured by the articles, causing an injury.

Patent Document 1 as stated below discloses a safety chest of drawers in which when one drawer is slidably opened, the other drawers are locked.

In the chest of drawers in Patent Document 1, a drawer slides and is held by a slide device including a fixed rail and a movable rail. However, the drawer locking structure to prevent the slide device and the drawer which is attached to the slide device from undesirably sliding and opening by an external vibration is very complicated and is formed separately from the slide device.

Patent Document 2 as stated below discloses a marine drawer guiding rail.

The marine drawer guiding rail of Patent Document 2 has a separate stopping structure in addition to a fixed rail and a movable rail. Even when a ship is rolling on the voyage, the stopping structure prevents the drawer from opening by itself. In the stopping structure, a stopper, which is stepped, is formed at a front end of a bottom of the fixed rail, and front and rear stop portions with stopping projections are respectively formed at front and rear ends of the movable rail to be fitted into the fixed rail.

In the marine drawer guiding rail of Patent Document 2, the drawer locking structure is provided in the fixed rail and the movable rail of the slide device but it is complicated, making it cumbersome to manufacture the slide device.

Further, in the marine drawer guiding rail of Patent Document 2, when a user wants to open a drawer, the user needs to release the locking state by lifting the front of the drawer and therefore it makes the sliding of the drawer difficult.

RELATED ART DOCUMENT

Patent Document

Patent Document 1. Korean Patent Registration No. 10-1730427 (registered on Apr. 20, 2017)

Patent Document 2. Korean Utility Model Registration No. 20-0377395 (registered on Feb. 21, 2005)

In the conventional art, since a movable body held by a fixed body is locked by a locking structure which is formed separately from a slide device to support the movement of the movable body, it is cumbersome to manufacture a drawer device, etc.

Further, in the case where a locking structure is provided with a slide device, it is difficult to manufacture the slide device and it is difficult to slide the drawer open.

SUMMARY OF THE INVENTION

Therefore, it is an object of the present invention to solve the above problems and to provide a slide device with a locking function which prevents a movable rail and a movable body from undesirably sliding due to an external vibration, by firmly securing the sliding state of the movable rail and the closed state of the movable body.

In accordance with an embodiment of the present invention, there is provided a slide device with a locking function to smoothly support the movement of a movable body, such as a drawer, to be movably installed in a fixed body, such as a box-type frame, which comprises: a fixed rail fixedly mounted on the fixed body; a first movable rail movably installed in the fixed rail in a forward-backward direction; a second movable rail movably installed in the first movable rail in the forward-backward direction and fixedly mounted on the movable body; a locking unit positioned at an inner front end of the fixed rail, to lock the second movable rail; and a locked member pivotally installed at an outer front end of the second movable rail, to be locked to the locking unit of the fixed rail by a pivot support pin.

The locked member is elastically supported by a spring.

The locking unit has a guide portion which is bent in an arc shape at an upper front end of the locking unit and a stopping projection portion at a rear of the guide portion.

The locking unit is integrally formed at the fixed rail by cutting an outer region of a material to be formed and then inwardly pressuring the region during the process of forming the fixed rail.

The locked member has a release lever/rod connection portion at an upper front end of the locked member and a stopped portion at an upper rear end thereof.

The release lever/rod connection portion is formed by outwardly horizontally bending a region of a material to be formed and downwardly vertically bending the region and the stopped portion is formed by outwardly horizontally bending a region of the material to be formed.

The spring is bent from backward to forward and has a hook portion which is formed by horizontally bending a front end of the spring and then downwardly vertically bending the front end, the hook portion is insertedly connected to the locked member and the upper portion of the spring is secured within the inner upper end of the second movable rail.

In the slide device with a locking function according to the present invention, since the movable rail is locked to the fixed rail during the process that the movable rail is held to the fixed rail, in the case where the movable rail is completely held to the fixed rail, even though an external vibration is applied, the movable rail does not move.

In the slide device with a locking function according to the present invention, since the movable rail is locked to the fixed rail which is mounted onto the fixed body when a movable body on which the movable rail is mounted is in a closed state, the movable body on which the movable rail is mounted does not slide away from the fixed body on which the fixed rail is mounted, due to the external vibration.

In the slide device with a locking function according to the present invention, the articles stored in the movable body are prevented from pouring out of the movable body and being damaged or injuring by falling when the movable body which is in the closed state encounters the external vibration.

BRIEF DESCRIPTION OF THE DRAWINGS

The above and other features and advantages of the present invention will become more apparent to those of ordinary skill in the art by describing in detail the preferred embodiment(s) thereof with reference to the attached drawings in which.

DESCRIPTION OF NUMBERS FOR CONSTITUENTS IN DRAWINGS

Figure 1:
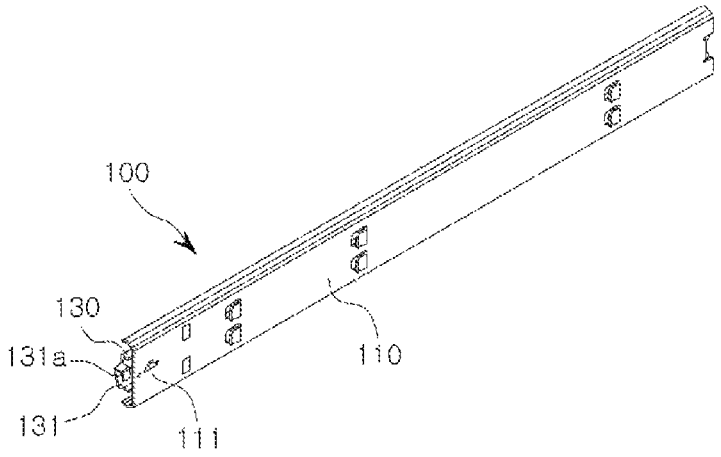
FIG. 1 is a perspective view of a movable rail which is held in a slide device with a locking function according to a preferred embodiment of the present invention.

100: slide device with a locking function
110: fixed rail
111: locking unit
111*a*: arc-shaped guide portion
111*b*: stopping projection portion
120: first movable rail
130: second movable rail
131: locked member
131*a*: release lever/rod connection portion
131*b*: stopped portion
132: pivot support pin
133: spring
200: release lever

DETAILED DESCRIPTION OF THE PREFERRED EMBODIMENT

The present invention will now be described more fully hereinafter with reference to the accompanying drawings, in which the preferred embodiment(s) of the invention is shown so that those of ordinary skill in the art can easily carry out the present invention.

The terms or words to describe the direction of an element (for example, "upward", "downward", "forward" and "backward", "clockwise", counter-clockwise", among others) are used based on the drawings.

A slide device with a locking function according to the present invention is to smoothly support the movement of a movable body, such as a drawer, which is movably installed to a fixed body, such as a box-type frame.

Figure 2:
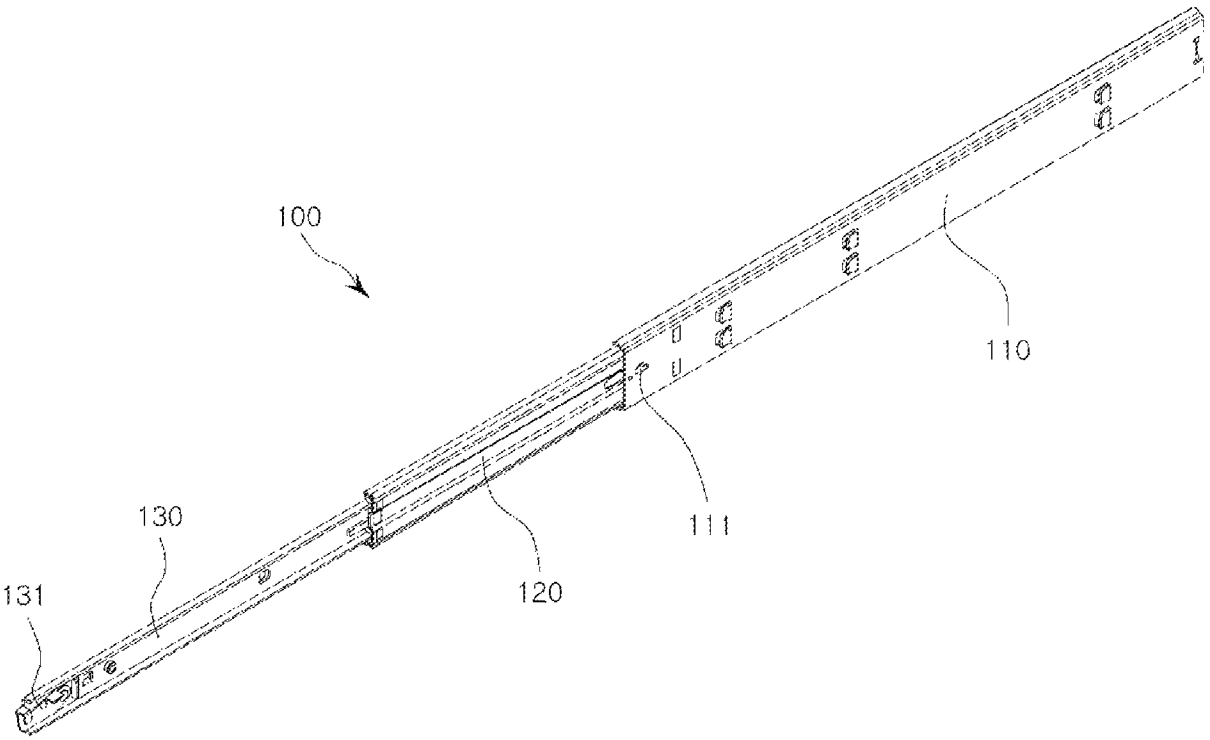
FIG. 2 is a perspective view of the movable rail which is slid in the slide device with a locking function according to the preferred embodiment of the present invention.

FIG. 1 is a perspective view of a movable rail which is held in a slide device 100 with a locking function according to a preferred embodiment of the present invention, and FIG. 2 is a perspective view of the movable rail which is slid.

The slide device 100 with a locking function includes a fixed rail 110, a first movable rail 120 and a second movable rail 130.

The fixed rail 110 supports the movement of the first movable rail 120 in a forward-backward direction and is secured to a fixed body such as a box-type frame.

The fixed rail 110 is fixedly installed at inner both sides of a holding space arranged in the fixed body.

The first movable rail 120 supports the movement of the second movable rail 130 in the forward-backward direction and is movably installed at the fixed rail 110 in the forward-backward direction.

The second movable rail 130 to be mounted on the movable body such as a drawer is movably installed at the first movable rail 120 in the forward-backward direction.

The second movable rail 130 is fixedly installed at both sides of the movable body which is held in the holding space of the fixed body.

Since the basic constitution of the slide device 100 with the first movable rail 120 which is movably installed at the fixed rail 110 and the second movable rail 130 which is movably installed at the first movable rail 120 in the forward-backward direction is obvious in the technical field to which the present invention belongs, no detailed description thereof will not be presented.

Figure 3:
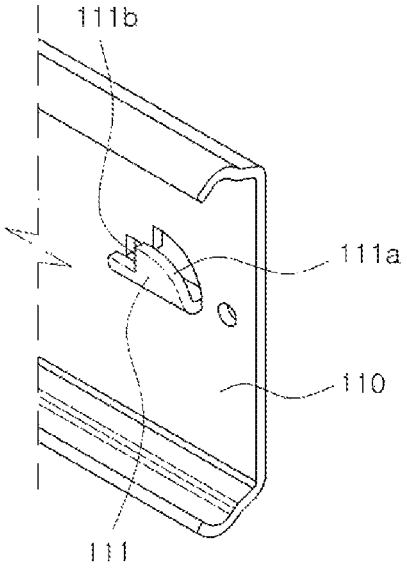
FIG. 3 is a perspective view of a front end of a fixed rail in the slide device with a locking function according to the preferred embodiment of the present invention.

FIG. 3 is a perspective view of a front end of the fixed rail 110 in the slide device 100 according to the present invention.

A locking unit 111 is integrally formed at an inner front end of the fixed rail 110.

The inner front end of the fixed rail 110 means a direction in which the first movable rail 120 and the second movable rail 130 are held.

The locking unit 111 is formed by cutting an outer region of a material to be formed and inwardly pressurizing the outer region as cut during a process of forming the fixed rail 100.

The locking unit 111 includes a guide portion 111*a* which is bent in an arc-shape at an upper front end and a stopping projection portion 111*b* formed at a rear of the guide portion 111*a*.

Figure 4:
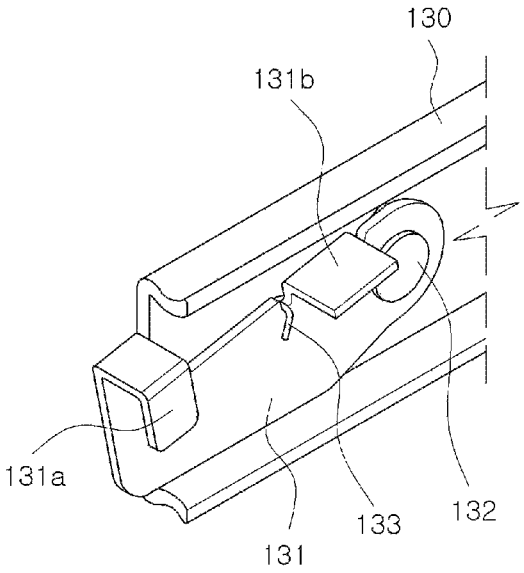
FIG. 4 is a perspective view of a main part of a second movable rail in the slide device with a locking function according to the preferred embodiment of the present invention.
Figure 5:
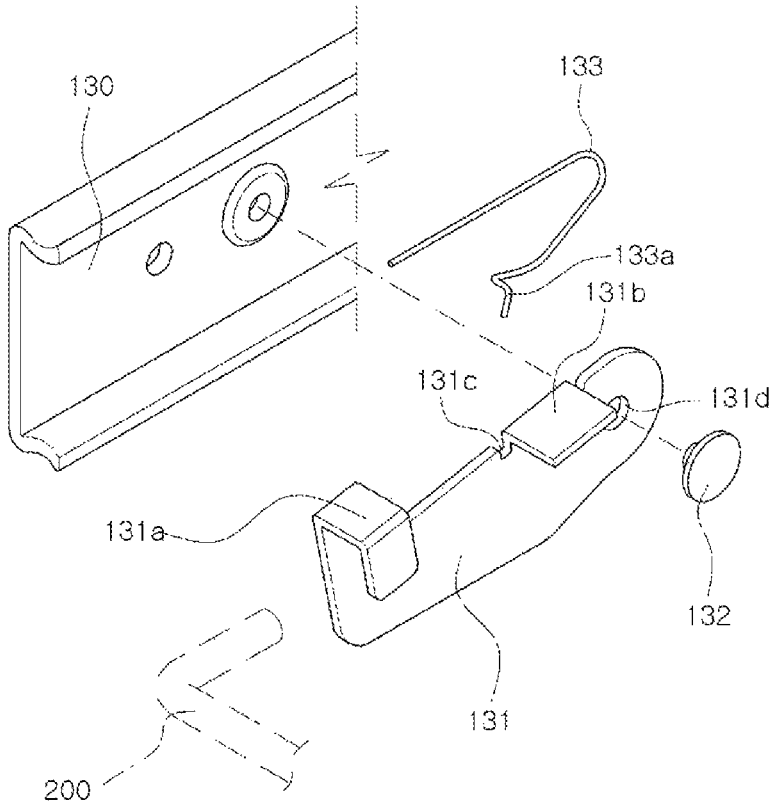
FIG. 5 is an exploded perspective view of the main part of the second movable rail in the slide device with a locking function according to the preferred embodiment of the present invention.

FIG. 4 is a perspective view of a main part of the second movable rail 130 in the slide device 100 according to the present invention and FIG. 5 is an exploded perspective view of the main part of the second movable rail 130.

The second movable rail 130 includes a locking member 131 to be pivotally positioned at an outer front end of the second movable rail 130.

The locked member 131 includes a release lever/rod connection portion 131*a* formed at an upper front end of the locked member 131*b* and a stopped portion 131*b* formed at an upper back end thereof.

The release lever/rod connection portion 131*a* is formed by outwardly horizontally bending a region to be formed and then downwardly vertically bending the region. The locked member 131*b* is formed by outwardly horizontally bending a region to be formed of the material.

A spring hanging groove 131*c* is formed at the front of the stopped portion 131*b* at a top of the locked member 131.

The locked member 131 is pivotally installed at the second movable rail 130 by using a pivot support pin 132.

A pivot support pin connection aperture 130*d* is formed at the front end of the second movable rail 130, and a pivot support pin passing aperture 131*d* is formed at the rear of the locked member 131.

The pivot support pin 132 passes through the pivot support pin passing aperture 131*d* of the locked member 131, to be connected to the pivot support pin connection aperture 130*d* of the second movable rail 130.

The locked member 131 is elastically supported by a spring 133.

The spring 133 is bent from backward to forward and includes a hook portion 133*a* which is formed by horizontally bending a front end of the spring and then downwardly vertically bending the front end.

The hook portion 133*a* of the spring 133 is insertedly connected to the spring hanging groove 131*c* of the locked member 131 and the upper portion of the spring 133 is secured within the inner upper end of the second movable rail 130.

In the slide device 100 with a locking function according to the present invention, when the second movable rail 130 mounted on the movable body such as a drawer is held in the fixed rail 110, the locked member 131 of the second movable rail 130 is locked to the locking unit 111 of the fixed rail 110.

The state when the second movable rail 130 is held in the fixed rail 110, for example, when the drawer is closed, means the state that the drawer is completely held in the box-type frame.

Since the state when the second movable rail 130 is held in the fixed rail 110 is the state when the second movable rail 130 is locked to the fixed rail 110 by the locked member 131 and the locking unit 111, even if an external vibration is applied to the second movable rail 130, the second movable rail 130 does not move or slide to the outside.

That is, even if an external vibration occurs, since the drawer does not move, the drawer does not slide from the box-type frame.

In the slide device 100 with a locking function according to the present invention, the second movable rail 130 can be slid from the fixed rail 110 by only releasing the locking state of the second movable rail 130.

Figure 6A:
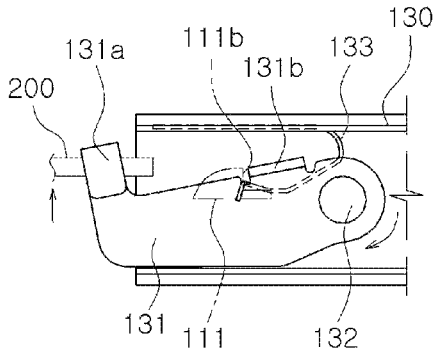
FIGS. 6A to 6C are side views of the main part of the second movable rail which is released from a locking state and slides in the slide device with a locking function according to the preferred embodiment of the present invention.
Figure 6B:
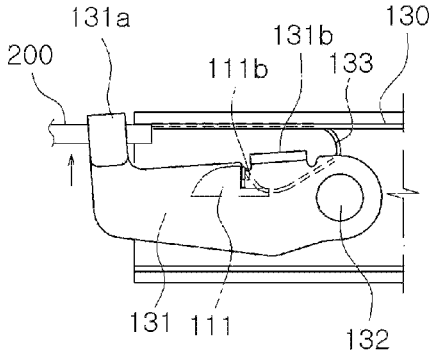
Figure 6C:
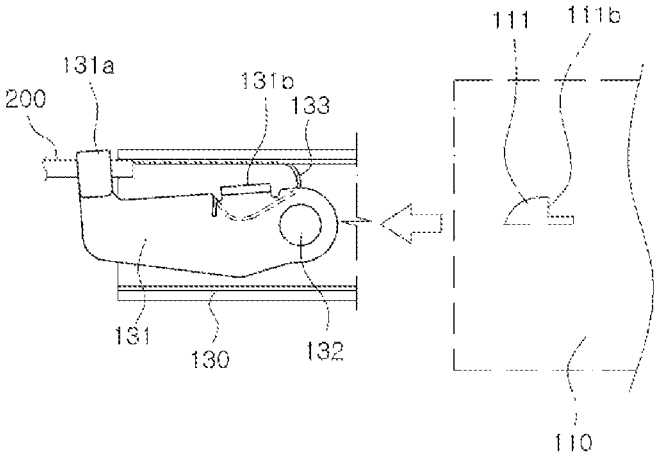

FIGS. 6A to 6C are side views of the main part of the second movable rail 130 which is released from the locking state and slides in the slide device 100.

As shown in FIG. 6A, at the state that the second movable rail 130 is held and locked in the fixed rail 110, when a user upwardly lifts the release lever/rod connection portion 131*a* of the locked member 131 by using a release lever 200, the locked member 131 which is elastically supported by the spring 133 pivots about the pivot support pin 132 clockwise.

When the locked member 131 pivots clockwise, as shown in FIG. 6B, the stopped portion 131*b* of the locked member 131 moves in an upward direction of the stopping projection portion 111*b* of he locking unit 111 of the fixed rail 110, so that the locking state is released.

If the user forwardly pulls the second movable rail 130 when the locking state of the locked member 131 is released, as shown in FIG. 6C, the second movable rail 130 is able to slide forwardly from the fixed rail 110.

In the slide device 100 with a locking function according to the present invention, when the second movable rail 130 which slides to the outside of the fixed rail 110 is again held inside the fixed rail 100, the second movable rail 130 is automatically locked in the fixed rail 110.

FIGS. 7A to 7D are side views of the main part of the second movable rail 130 which is held and locked in the slide device 100.

Figure 7A:
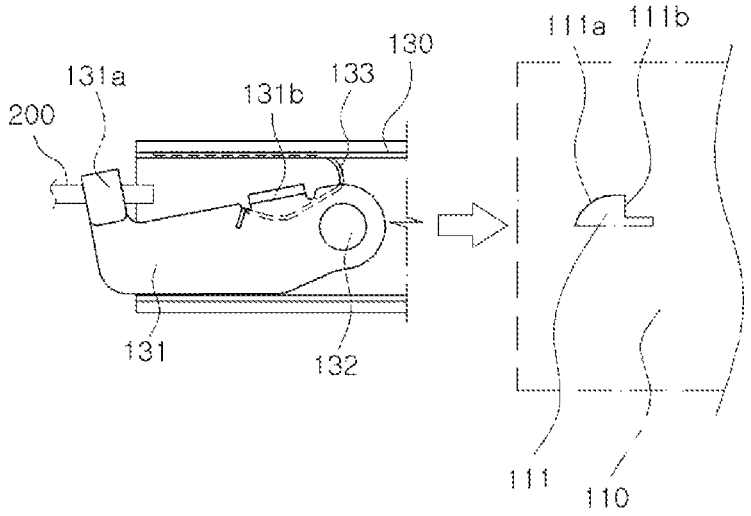
FIGS. 7A to 7D are side views of the main part of the second movable rail which is held and locked in the slide device with a locking function according to the preferred embodiment of the present invention.

As shown in FIG. 7A, at the state that the second movable rail 130 slides from the fixed rail 110, a front region of the locked member 131 is kept in a maximally descending state by the elasticity of the spring 133.

Figure 7B:
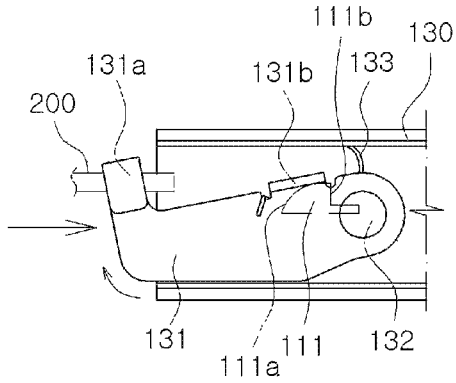

When the user backwardly pushes the second movable rail 130 to be held in the fixed rail 110, as shown in FIG. 7B, a rear end of the stopped portion 131*b* of the locked member 131 is in contact with the arc-shaped guide portion 111*a* of the locking unit 111 of the fixed rail 110.

At the state that the rear end of the stopped portion 131*b* of the locked member 131 is in contact with the arc-shaped guide portion 111*a* of the locking unit 111 of the fixed rail 110, when the user pushes the second movable rail 130 towards the fixed rail 110, the stopped portion 131*b* of the locked member 131 is guided to move backwardly by the arc-shaped guide portion 111*a* of the locking unit 111 of the fixed rail 110.

When the stopped portion 131*b* of the locked member 131 is guided by the arc-shaped guide portion 111*a* of the locking unit 111 of the fixed rail 110 so that the stopped portion 131*b* backwardly moves, the locked member 131 compresses the spring 133 and clockwise pivots around the pivot support pin 131.

Figure 7C:
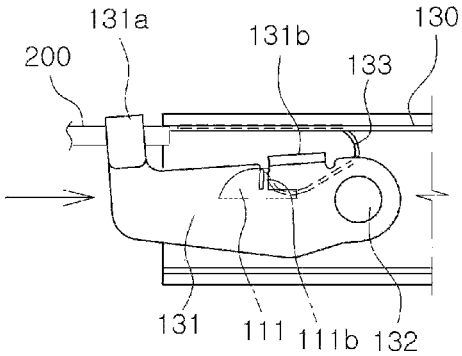

As shown in FIG. 7C, when a front end of the stopped portion 131*b* of the locked member 131 passes the stopping projection portion 111*b* of the locking unit 111 of the fixed rail 110 during the second movable rail 130 and the locked member 131 backwardly move, the locked member 131 counter-clockwise pivots by the elasticity of the spring 133.

Figure 7D:
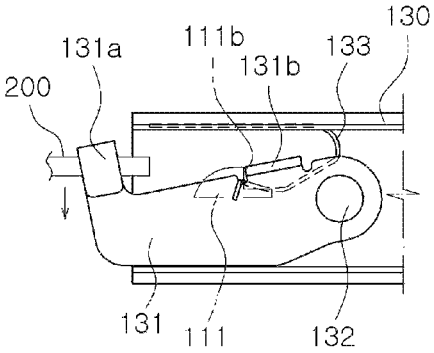

When the locked member 131 counter-clockwise pivots by the elasticity of the spring 133 after the front end of the stopped portion 131*b* of the locked member 131 passes the stopping projection portion 111*b* of the locking unit 111 of the fixed rail 110, as shown in FIG. 7D, the front end of the locked member 131 maximally descends by the elasticity of the spring 133 and simultaneously the front end of the stopped portion 131*b* of the locked member 131 is caught in the stopping projection portion 111*b* of the locking unit 111 of the fixed rail 110. Thus, even if the user forwardly pulls the second movable rail 130, the second movable rail 130 is in the locking state that it is unable to slide from the fixed rail 110.

As described above, the slide device 100 with a locking function according to the present invention securely locks the second movable rail 130 held in the fixed rail 110. In other words, when the drawer on which the second movable rail 130 is mounted is held in the box-type frame on which the fixed rail 110 is mounted, the drawer is prevented from moving or sliding from the box-type frame by an external vibration.

Further, in the slide device 100 with a locking function according to the present invention, when the locking state of the second movable rail 130 is released by lifting the locked member 131 by using the release lever, the second movable rail 130 is easily slid from the fixed rail 110. In other words, in a case where the release lever is connected to a handle of the drawer, the locking state of the drawer is easily released by operating the handle and the drawer is slid.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. Simple modifications or similar arrangements of the present invention belong to the category of the invention and therefore, the protection range of the invention will be apparent by the claims attached herewith.

What is claimed is:

1. A slide device with a locking function, which is configured to support a movement of a movable body to be movably installed in a fixed body, the slide device comprising:

a fixed rail configured to be fixedly mounted on the fixed body;

a first movable rail movably installed in the fixed rail in a forward-backward direction;

a second movable rail movably installed in the first movable rail in the forward-backward direction and configured to be fixedly mounted on the movable body;

a locking unit positioned at an inner front end of the fixed rail, to lock the second movable rail; and a locked member pivotally installed at an outer front end of the second movable rail, to be locked to the locking unit of the fixed rail by a pivot support pin, wherein the locking unit has a guide portion bent in an arc shape at an upper front end of the locking unit and a stopping projection portion at a rear of the guide portion, and wherein the locking unit is integrally formed at the fixed rail by cutting an outer region of a material to be formed into the fixed rail and then inwardly pressurizing the outer region during a process of forming the fixed rail.

2. The slide device with according to claim 1, wherein the locking unit has a guide portion which is bent in an arc shape at an upper front end of the locking unit and a stopping projection portion at a rear of the guide portion.

3. A slide device with a locking function, which is configured to support a movement of a movable body to be movably installed in a fixed body, the slide device comprising:

a fixed rail configured to be fixedly mounted on the fixed body;

a first movable rail movably installed in the fixed rail in a forward-backward direction;

a second movable rail movably installed in the first movable rail in the forward-backward direction and configured to be fixedly mounted on the movable body;

a locking unit positioned at an inner front end of the fixed rail, to lock the second movable rail; and a locked member pivotally installed at an outer front end of the second movable rail, to be locked to the locking unit of the fixed rail by a pivot support pin, wherein the locked member has a release lever/rod connection portion at an upper front end of the locked member and a stopped portion at an upper rear end thereof, wherein the release lever/rod connection portion is formed by outwardly horizontally bending a region of a material to be formed into the locked member and downwardly vertically bending the region, and the stopped portion is formed by outwardly horizontally bending another region of the material to be formed into the locked member.

4. A slide device with a locking function, which is configured to support a movement of a movable body to be movably installed in a fixed body, the slide device comprising:

a fixed rail configured to be fixedly mounted on the fixed body;

a first movable rail movably installed in the fixed rail in a forward-backward direction;

a second movable rail movably installed in the first movable rail in the forward-backward direction and configured to be fixedly mounted on the movable body;

a locking unit positioned at an inner front end of the fixed rail, to lock the second movable rail; and a locked member pivotally installed at an outer front end of the second movable rail, to be locked to the locking unit of the fixed rail by a pivot support pin, wherein the locked member is elastically supported by a spring, wherein the spring is bent from backward to forward and has a hook portion which is formed by horizontally bending a front end of the spring and then downwardly vertically bending the front end, and wherein the hook portion is insertedly connected to the locked member and the upper portion of the spring is secured within the inner upper end of the second movable rail.

* * * * *